US006044129A

United States Patent [19]

Miller et al.

[11] Patent Number: 6,044,129

[45] Date of Patent: Mar. 28, 2000

[54] GAS OVERLOAD AND METALIZATION PREVENTION FOR X-RAY TUBES

[75] Inventors: Lester D. Miller, Hudson, Ohio; James E. Burke, Glenview; Donald F. Decou, Jr., Naperville, both of Ill.

[73] Assignee: Picker International, Inc., Cleveland, Ohio

[21] Appl. No.: 08/975,727

[22] Filed: Nov. 21, 1997

[51] Int. Cl.[7] ..... H01J 35/04

[52] U.S. Cl. ..... 378/125; 378/119

[58] Field of Search ..... 378/113, 119, 378/121, 123, 125, 124, 127, 129, 141, 142, 139

[56] References Cited

U.S. PATENT DOCUMENTS 3,243,636 3/1966 Nineuil ..... 378/123
3,735,176 5/1973 Langer et al. ..... 378/125
4,315,182 2/1982 Furbee .
4,414,681 11/1983 Seifert ..... 378/144
5,509,045 4/1996 Kautz .

*Primary Examiner*—David P. Porta
*Attorney, Agent, or Firm*—Timothy B. Gurin; John J. Fry; Eugene E. Clair

[57] ABSTRACT

An x-ray tube includes an anode, a cathode, and an electrode disposed in an evacuated envelope. The electrode is positioned such that the electrode is remote from an area in immediate proximity to the envelope. An electric field defined by electrode is of sufficient strength such that arcing preferentially occurs between the electrode and the anode as opposed to occurring between the cathode and anode. The electrode is further situated such that metal sputtered from the electrode substantially falls in a define region on the anode and serves as an active getter for pumping gas from the envelope. The electrode is composed of an active metal which, upon being passively heated by the anode, also acts as a getter material to aid in pumping gas from the envelope.

30 Claims, 5 Drawing Sheets

GAS OVERLOAD AND METALIZATION PREVENTION FOR X-RAY TUBES

TECHNICAL FIELD

The present invention relates to x-ray tubes and particularly to the prevention of metalization deposits forming within the x-ray tube. It finds particular application in conjunction with x-ray sources for computed tomographic ("CT") scanners and will be described with particular reference thereto. It will be appreciated, however, that the invention may find further application in connection with x-ray tubes for other applications, and the like.

BACKGROUND OF THE INVENTION

Conventional diagnostic use of x-radiation includes the form of radiography, in which a still shadow image of the patient is produced on x-ray film, and fluoroscopy, in which a visible real time shadow light image is produced by low intensity x-rays impinging on a fluorescent screen after passing through the patient.

In a typical x-ray tube, electrons are generated from a filament coil heated to thermionic emission. The electrons are accelerated as a beam from a tube cathode through an evacuated chamber defined by a glass envelope, toward a target anode. When the electrons strike the anode with large kinetic energies and experience a sudden deceleration, x-radiation is produced. An x-ray tube assembly is contained in a housing which includes a window transmissive to x-rays, such that radiation from the anode passes through the window toward a subject undergoing examination or treatment.

Most x-ray tube designs employ filaments as a source of electrons. A filament is a coil of wire which is electrically energized so that electrons are thermionically emitted from the filament and accelerated toward the anode due to a very large DC electrical potential difference between the cathode and the anode. Often this electrical potential difference is of the order of 150,000 volts, (±75,000 volts to ground) necessitating significant electrical isolation between the various tube components.

Despite the electrical isolation, when two elements with 150 kV difference in potential are placed proximate to each other, there is a tendency to arc. An arc is an undesired surge of electrical current between two elements which are at a different electrical potential and typically occurs through gas molecules present in the x-ray tube. In x-ray tubes, this tendency to arc often increases as the tube ages due to such factors as degradation of the vacuum within the tube due to the existence of additional undesired gas molecules. When the x-ray tube arcs, a current on the order of hundreds of amperes can flow between the cathode and the anode. Once an x-ray tube starts to arc, an avalanche type effect may occur sputtering metal and the metal atoms as well as ionizing the contaminants in the vacuum.

Arcing typically occurs in the area of the x-ray tube having the highest electric field strength. As such, arcing in an x-ray tube will commonly occur in the same region as where the cathode is supplying the anode with electrons for the production of x-ray emissions. The sputtering of metal from the cathode produced during arcing often lands on the internal surface of the glass envelope in proximity to the cathode. The existence of the metal deposits on the glass envelope can deleteriously effect x-ray tube performance for several reasons. First, as arcing occurs from time to time, sputtered metal deposits will continue to grow. As the sputtered metal deposits on the glass envelope gets too thick, an electrical charge may accumulate sufficient to damage the glass envelope thereby rendering the tube non-functional. Secondly, sputtered metal deposits on the glass envelope will often attract arcing between the deposits and the cathode. The surges of electrical current produced during arcing can damage the glass envelope, again rendering the tube non-functional. Additionally, the metal deposits also cause the glass surface area below the metal deposits to remain at a higher temperature than the glass would normally remain without such metal deposits. The higher glass temperatures in these regions causes further instability in the glass.

Attempts to reduce these and other negative effects of sputtered metal on the glass envelope include a method described in U.S. Pat. No. 4,315,182 ('182) assigned to Picker International. In the '182 Patent a method of roughing the internal surface of the glass envelope is described which causes the sputtered metal deposits to be spread out thereby helping to prevent charge build up on the glass envelope. Although the method described in the '182 Patent does offer significant benefits to maintaining the integrity of the x-ray tube, further improvements are still possible.

Attempts have also been made to reduce arcing. One known method to reduce arcing involves providing getter material inside the glass envelope to help maintain the evacuated state. The getter material binds gases on its surface and absorbs such gases to maintain the vacuum state in the x-ray tube. The process of removing residual gases from an evacuated area by binding and absorbing is known as pumping. By using getter material to maintain a vacuum state, arcing is minimized since there is a reduction in the number of gas molecules through which large current surges may flow. Unfortunately, as the x-ray tube ages the effectiveness of the getter material in pumping also diminishes. As a result, arcing tends to become more frequent as the tube ages.

Therefore, what is needed is a method and apparatus for maintaining the integrity and reliability of the x-ray tube as it ages. More specifically, what is needed is a method and apparatus for minimizing the amount of sputtered metal which accumulates on the envelope of an x-ray tube and for increasing the gas pumping ability of an x-ray tube which reduces and/or resolves the above-referenced difficulties and others.

SUMMARY OF THE INVENTION

An x-ray tube includes a cathode and an anode situated in an substantially evacuated chamber defined by an envelope. An electrode is positioned within the chamber at a location which is remote from an internal surface of the envelope. In a preferred embodiment of the invention, the position of the electrode is such that an electric field strength between the electrode and the anode is greater then the electric field strength between the cathode and the anode. In this manner, arcing is more apt to occur at ajunction between the electrode and the anode then at ajunction between the cathode and the anode. The electrode is further situated such that metal sputtered from the electrode falls substantially in a desired region remote from an internal surface of the envelope.

In the preferred embodiment the electrode is composed of an active metal having a low vapor pressure. By composing the electrode of an active metal, the electrode acts as a getter for pumping gas from the envelope when the electrode is passively heated by the anode during normal operations. Further, metal sputtered from the electrode during arcing and at other times falls in a harmless region such as along a surface of the anode. The sputtered metal also serves as a getter material for pumping gas. The heated electrode additionally contributes to maintaining the evacuated state of the glass tube by acting as an ion pump by releasing electrons which ionize gas molecules thereby causing the gas molecules to be absorbed back into the cathode. By using an active metal with a low vapor pressure, the electrode does not substantially contribute to the gas load within the glass envelope.

In accordance with one aspect of the invention an x-ray tube is provided. The x-ray tube includes a cathode, an anode, an envelope encompassing the cathode and the anode which defines a substantially evacuated region in which the cathode and the anode operate to produce x-rays, and a means for producing an electric field of a desired strength in a region remote from an internal surface of the envelope.

In accordance with another aspect of the present invention, an x-ray tube is provided. The x-ray tube includes a cathode, an anode, and an envelope encompassing the cathode and the anode which defines a substantially evacuated region in which the cathode and the anode operate to produce x-rays. The x-ray tube further includes a means for pumping gas from the envelope upon being passively heated by the anode.

In accordance with yet another aspect of the present invention, an x-ray producing apparatus is provided. The x-ray producing apparatus includes an x-ray tube and a housing for mounting the x-ray tube. The x-ray tube includes a cathode, an anode, an envelope in which the cathode and the anode are disposed which defines a substantially evacuated region in which the cathode and anode operate to produce x-rays, and an electrode disposed in the envelope and positioned such that a substantial portion of metal sputtered from the electrode falls in a defined region remote from an internal surface of the envelope.

In accordance with still another aspect of the present invention, a method of reducing an amount of metal sputtered onto an internal surface of an envelope of an x-ray tube is provided. The method includes the step of creating an electric field of a desired strength in a region remote from the internal surface of the envelope. The desired strength is such that arcing is more likely to occur in the region remote from the internal surface of the envelope than a region proximate the internal surface of the envelope.

In accordance with still another aspect of the present invention, a method of creating an electric field of a desired strength in an x-ray tube is provided. The x-ray tube includes a cathode, an anode, and an envelope encompassing the cathode and the anode and providing a substantially evacuated region in which the cathode and the anode operate to produce x-rays. The method includes the steps of positioning an electrode within the envelope at a location remote from an internal surface of the envelope, the electrode defining an electric field of a strength such that arcing preferentially occurs between the electrode and the anode, and mechanically coupling the electrode to the cathode in the position.

It is an advantage of the present invention that metal from the cathode sputtering onto an internal surface of the x-ray tube envelope is reduced.

It is another advantage of the present invention that the electrode disposed in the x-ray tube envelope is made of an active metal which, upon being passively heated by the anode, serves as a getter material for pumping gas from the x-ray tube envelope.

It is still another advantage of the present invention that metal sputtered from the electrode disposed in the x-ray tube envelope substantially falls in a defined region which is remote from an internal surface of the glass envelope and the metal sputtered from the electrode acts a getter material for pumping gas from the x-ray tube envelope.

It is yet another advantage of the present invention that the electrode disposed in the x-ray tube serves as an ion pump for removing gas from the x-ray tube envelope.

To the accomplishment of the foregoing and related ends, the invention then, comprises the features hereinafter fully described and particularly pointed out in the claims. The following description and the annexed drawings set forth in detail certain illustrative embodiment of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PREFERRED EMBODIMENTS

Figure 1:
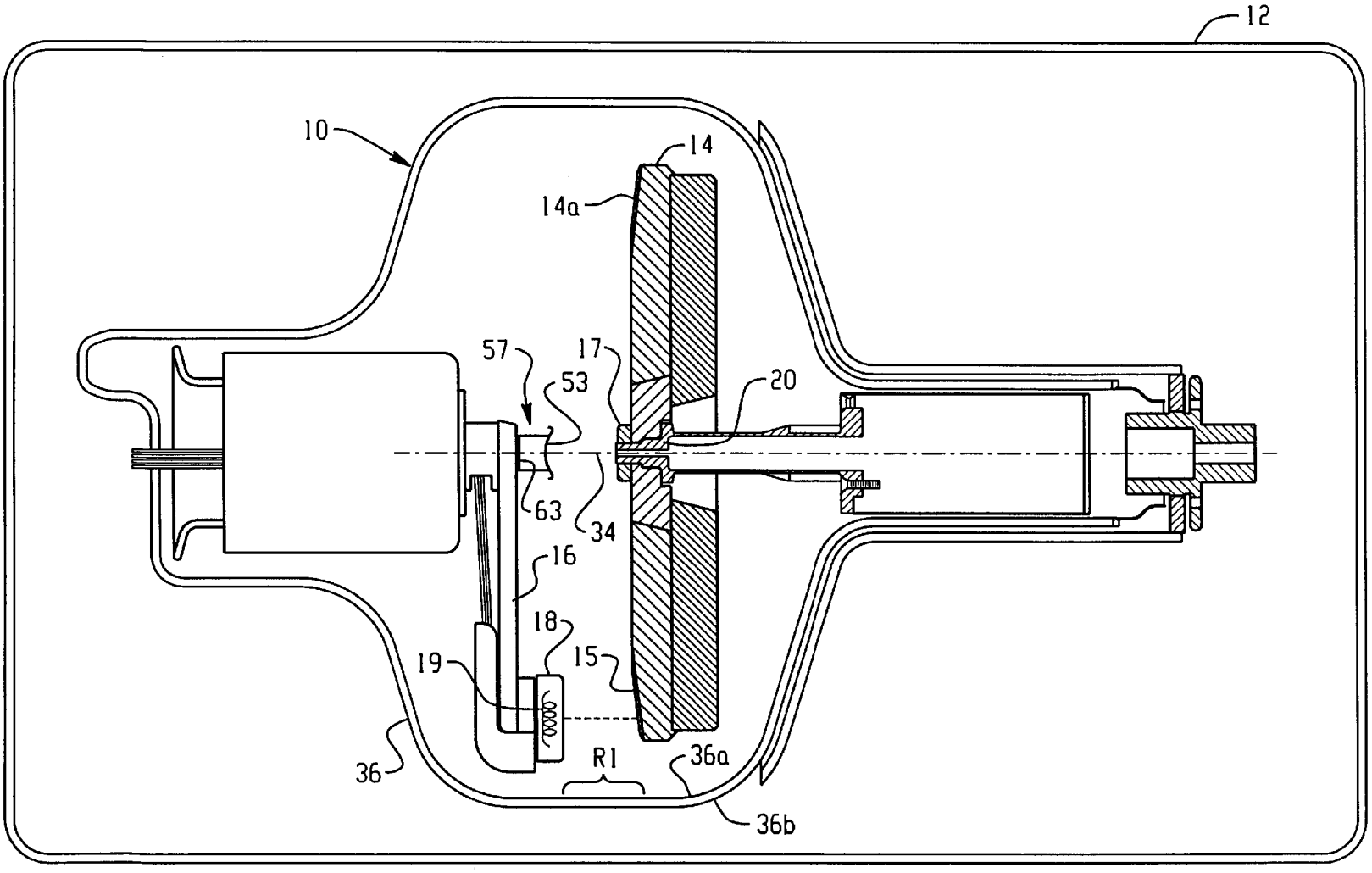
FIG. 1 is diagrammatic view in partial section of an x-ray tube supported by a housing in accordance with the present invention.

The present invention will now be described with reference to the drawings in which like reference numerals are used to refer to like elements throughout.

Turning now to the drawings, FIG. 1 discloses an x-ray tube 10 mounted within an x-ray tube housing 12. The housing 12 can be of any conventional type and, therefore, further details relating to the housing 12 are omitted for sake of brevity. The x-ray tube 10 includes an anode 14 having an anode surface 14*a*. An x-ray tube cathode 16 including a cathode focusing cup 18 is positioned in a spaced relationship to the surface 14*a*. A cathode filament 19 mounted to the cathode focusing cup 18 is energized to emit electrons which are accelerated to the anode 14 to produce x-radiation for diagnostic imaging, therapy treatment and the like. The cathode focusing cup 18 acts as a lens to focus electrons to a focal spot 15 on the anode 14.

The x-ray tube anode 14 is mounted is mounted to shaft 20 using securing nut 17 for rotation about an axis 34. Both the rotating anode 14 and a fixed cathode 16 are mounted within an evacuated envelope 36 having an internal and external surface 36*a*, 36*b*, respectively. The envelope 36 is preferably made of glass, however other suitable material including other ceramics or metals such as copper or steel could also be used. Electrons emitted by the cathode filament accelerate toward the focal spot 15 on the anode 14 and cause x-rays to be emitted. The anode 14 is rotated in a known manner to distribute the localized heating about the anode 14 circumference.

Further details regarding the construction and arrangement of an x-ray tube 10 and its housing 12 may be obtained by referring to U.S. Pat. No. 4,097,759 to Furbee et al., which is assigned to the assignee of the present invention and is hereby incorporated by reference.

As discussed in the background section, the prior art x-ray tubes have several operational drawbacks which may deleteriously effect operation of the x-ray tube 10. More specifically, as the evacuated state maintained within the glass envelope 36 slowly diminishes over time, arcing between the anode 14 and the cathode focusing cup 18 increases. The evacuated state diminishes due in part to the fact that gas molecules are continually released into the glass envelope 36 from elements within the x-ray tube 10 during normal operations. Further, getter material present within the envelope 36 to aid in absorbing gas molecules from the evacuated chamber wears over time and becomes less effective in pumping unwanted gas molecules from the envelope 36. As the greatest electric field strength typically exists between the cathode focusing cup 18 and the focal spot 15 on the anode surface 14*a*, arcing most commonly occurs between these two regions. Unfortunately, given the location of the cathode focusing cup 18, sputtered metal from the cathode focusing cup 18 caused during arcing often falls on the internal surface 36*a* of the envelope 36 in a region proximate the cathode focusing cup 18. This region is shown in FIG. 1 generally as region R1. As discussed above, deposits of the sputtered metal can eventually deleteriously effect operation of the x-ray tube 10. Further, as the cathode focusing cup 18 is typically made of a non-active material such as iron, nickel, or molybdenum, the sputtered metal from the cathode focusing cup 18 which settles on the internal surface 36*a* of the envelope 36 and in other regions does not serve as a getter material to aid in pumping gases from the envelope 36 given the inert properties associated with these metals.

Continuing to refer to FIG. 1, the x-ray tube 10 of the present invention includes an electrode 53 in a region or position remote from an area in immediate proximity of the cathode focusing cup 18 and envelope 36. In the preferred embodiment the electrode 53 can be made of any active metal such as zirconium, titanium, or tantalum although non-active metals or other electrical conductive materials may be used. One reason for selecting an active metal for the electrode 53 is to add beneficial properties to the x-ray tube 10 from the sputtering of metal from the electrode 53. More specifically, sputtered metal from an electrode 53 comprised of an active metal acts as a getter material. In addition to being an active metal, it is also preferable that the material from which the electrode 53 is made have a low vapor pressure. When the electrode 53 is passively heated by the anode 14, the electrode 53 thus does not evolve gas molecules which contribute to the gas load of the x-ray tube 10.

Although the electrode 53 is shown to be centered generally along the rotating axis 34 of the x-ray tube anode 14, it is to be understood that the placement of the electrode 53 could be at any suitable location within the x-ray tube 10. Suitable locations in the x-ray tube 10 includes a location where the electrode 53 is capable of being passively heated by the anode 14 such the electrode 53 acts like a getter material for pumping gas. Further, a suitable location includes a location where metal sputtered from the electrode 53 falls into a region remote from the envelope 36. Additionally, a suitable location includes a location where an electric field strength between the electrode 53 and the anode 14 is greater than an electric field strength between the cathode focusing cup 18 and the anode 14. In such a case, arcing that would often occur in a region proximate the internal surface 36*a* of the envelope 36 preferentially occurs or, in other words, is more likely to occur at ajunction between the electrode 53 and the anode 14 having the stronger electric field. In the present embodiment, the electrode 53 is preferably located such that all of the above benefits are achieved.

Figure 2:
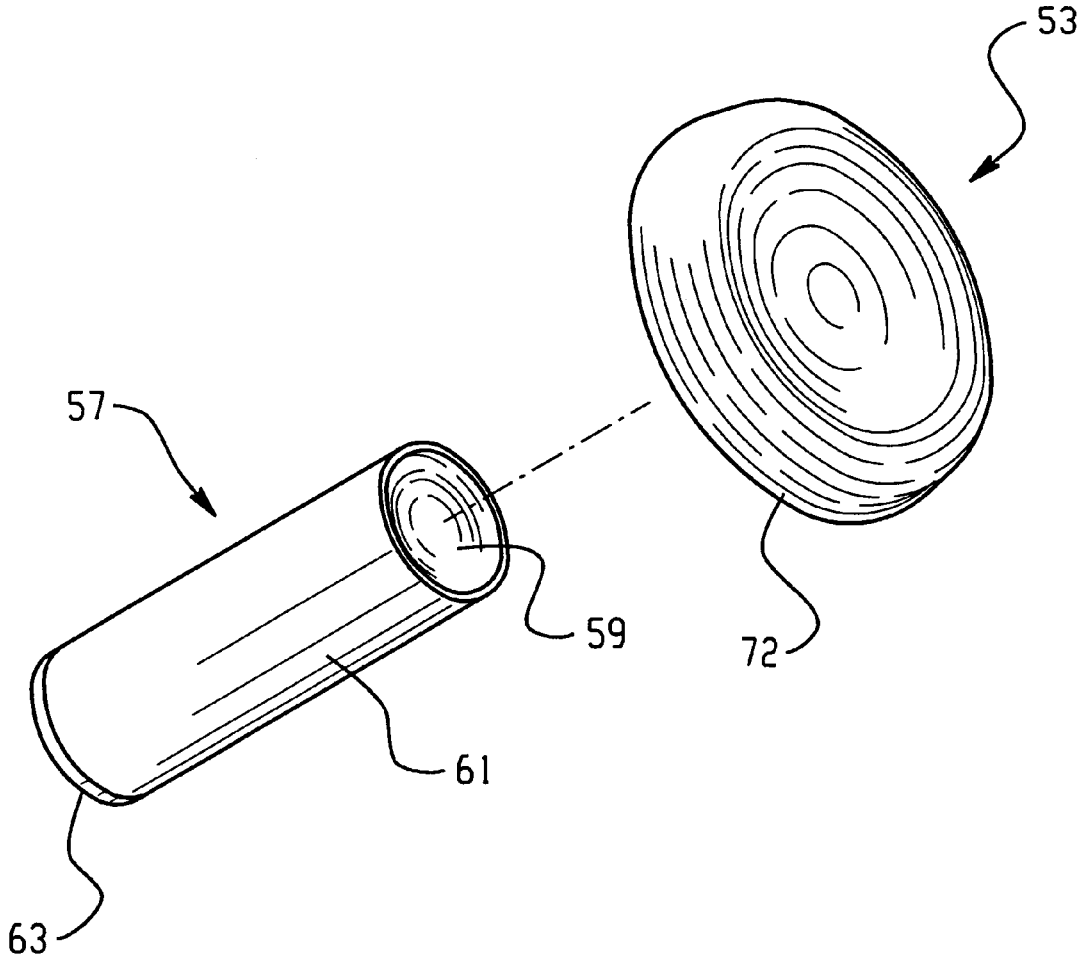
FIG. 2 is a partially exploded isometric view of an electrode and standoff included in the x-ray tube of FIG. 1.

The electrode 53 is mechanically secured to the cathode 16 via a standoff 57. The standoff 57 may be made of a variety of substances, however, in the preferred embodiment is composed of a ceramic material 59 having a thin metallic coating 61 (FIG. 2). The ceramic material allows the standoff 57 to withstand high temperatures without being damaged The metallic coating 61 causes the electrode 53 to be maintained at the same electrical potential as the cathode 16. Without such a metallic coating 61, the electrode 53 would be at an undetermined electrical potential resulting in an undetermined electric field strength in a region between the electrode 53 and the anode 14. In the preferred embodiment, the metallic coating 61 is made of titanium, although any other suitable metal could been used. The electrode 53 is brazed to the standoff 57 at an end of the standoff 57 closest the anode 14. An opposite end of the standoff 57 is shown to have a metal layer 63 brazed thereon. The metal layer 63 is spot welded or laser welded to the cathode 16. Other means for securing the standoff 57 to the cathode 16 such as screws or a mechanical anchor or clip could alternatively be used.

Although the preferred embodiment shows the electrode 53 mechanically coupled to the cathode 16 via the standoff 57, it will be appreciated that other mounting methods and locations could alternatively be used. For instance, rather then using the standoff 57, one or more support rods could be used to support and position the electrode 53 at the desired location. Additionally, the support mechanism for the electrode 53 could be secured to the envelope 36, anode 14, or any other element inside the envelope 36.

Figure 3:
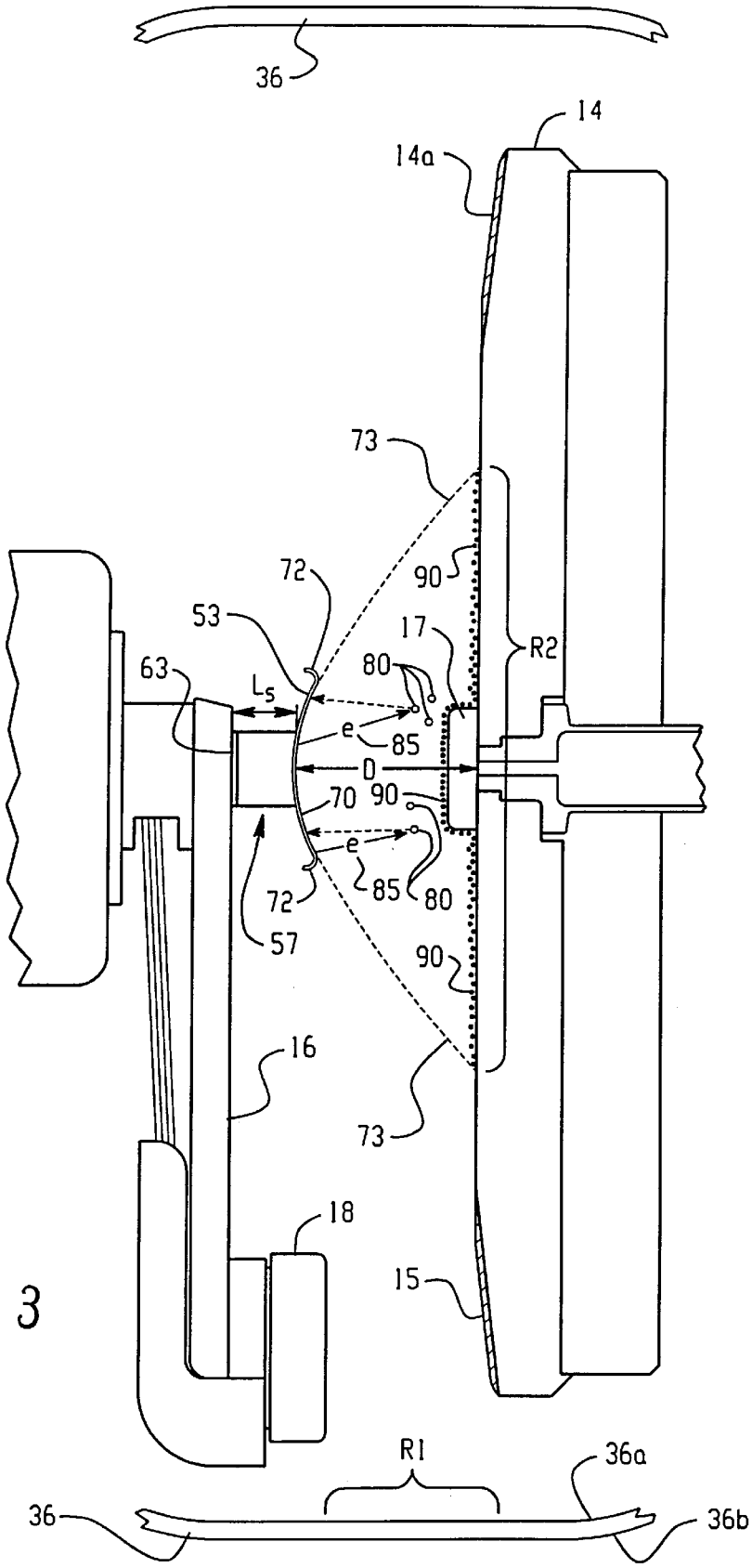
FIG. 3 is an enlarged view of the anode and cathode portions of the x-ray tube of FIG. 1.

Referring now to FIGS. 2 and 3, the orientation between the electrode 53 and anode 14 is shown in more detail. As shown, the electrode 53 is mechanically coupled to the standoff 57 and spaced at a distance D from the anode surface 14*a* The distance D the electrode 53 is to be placed from the anode surface 14*a* is dependent of the x-ray tube characteristics, but typically is in the range of one to two centimeters. Determination of the electric field strength as a function of both the distance D the electrode 53 is from the anode 14 and the shape of the electrode 53 is well known in the art. Depending on what distance D is selected, the standoff 57 is sized to have a length $L_s$ suitable to accommodate the electrode 53 being situated the distance D from the anode surface 14*a*. The electrode 53 itself is shown to be thin circular disc and shaped to have inwardly curved concave face 70 facing the anode surface 14*a*. Further, the electrode 53 includes an axisymmetric curved portion 72 along a peripheral portion of its outer circumference. The thickness of the electrode 53 is typically of the order of 0.5 to 1 millimeter but may be varied to accommodate the needs of the x-ray tube 10. As discussed below, the thickness of the electrode 53 plays a part in determining to what temperature the electrode 53 can be passively heated by the anode 14.

Depending on the size of the electrode 53 and spacing of the electrode 53 from the anode 14, the electric field strength between the electrode 53 and anode 14 can be made to be greater than, less than or equal to the existing electric field strength between the cathode focusing cup 18 and the anode 14. In the event the electric field strength between the electrode 53 and anode 14 is greater than the existing electric field strength between the cathode focusing cup 18 and the anode 14, arcing preferentially occurs or is more likely to occur within the region of the electrode 53 and the anode 14. As a result, sputtering caused by the arcing tends to be localized to regions remote from the envelope 36.

The placement of the electrode 53 not only plays a part in achieving the proper electrical field strength between the electrode 53 and the anode 14 but also contributes to how well the electrode 53 serves as an active getter to pump gas. As is conventional, during the production of x-rays, the anode 14 becomes heated to a very high temperature typically on the order of 1200–1400° C. As the electrode 53 is not coupled to the anode 14 by any thermally conductive path, the electrode 53 is not directly heated by the anode 14. Rather, the electrode 53 is passively heated by the anode 14 via heat radiated by the anode 14. By selecting a thin electrode 53 and placing the electrode 53 in close proximity (i.e. one to two centimeters) to the anode surface 14*a*, the electrode 53 is preferably heated by heat radiating from the anode 14 to a temperature of between 600–1000° C. In this temperature range, the active metal of the electrode 53 serves as a getter to pump gas coming into contact with the electrode 53 thereby helping maintain the evacuated state of the x-ray tube 10. More specifically, when gas molecules come into contact with the active metal of the electrode 53 heated to between 600–1000° C., the characteristics of the active metal are such that gas molecules bond to the active metal, thereby removing the gas molecule from the evacuated chamber of the envelope 36. Depending on the type of active metal used, the temperature range in which the metal is able to serve as a getter material may, of course, vary.

Continuing to refer to FIG. 3, the electrode 53 is shown to further help maintain the vacuum state of the x-ray tube 10 by serving as an ion pump. Because of the existing electric field between the electrode 53 and the anode 14, electrons 85 are emitted from the electrode 53 and travel towards the anode 14 during normal operations. In the process of traveling from the electrode 53 to the anode 14, the electrons 85 may collide with existing gas molecules 80 in this region thereby ionizing the gas molecules 80. The ionized gas molecules 80 then retreat back into the cathode 16 via the electrode 53 where they form a stable hydride and are thus removed from the evacuated chamber enclosed by the envelope 36.

At a point in which the ionized gas molecules 80 retreating back to the cathode 16 come into contact with the electrode 53, the electrode 53 is caused to sputter active metal. The sputtered active metal is heated by the anode 14 and acts like a getter to help maintain the vacuum state of the x-ray tube 10. As shown in FIG. 3, a layer of sputtered metal 90 tends to concentrate in a region generally specified by R2 on the anode surface 14*a* The region R2 is remote from the internal or internal surface 36*a* of the envelope 36 thereby ensuring that substantially no sputtered metal lands on the internal surface 36*a* of the envelope 36. The size and shape of the region R2 is at least in part defined by the shape of the electrode 53. More specifically, given that the axisymmetric curved portion 72 of the electrode 53 curves away from the high temperature anode 14, metal sputtered from the electrode 53 substantially remains within a defined region depicted by dashed lines 73 in FIG. 3. Thus, although it is possible for small amounts of the sputtered metal from the electrode 53 to settle at other areas in the envelope 36 including areas of the internal surface 36*a* of the envelope 36, the shape of the electrode 53 is such that a substantial portion of the sputtered metal falls within the region R2 remote from the envelope 36. As the effectiveness of getter material is not based on the number of layers or thickness of such material at any one location, but rather based on the amount of surface area such material covers, the shape of the electrode 53 can be varied to increase the region R2 in which metal sputters from the electrode 53 while still balancing the effect a change in shape of the electrode 53 may have on the electric field strength. It will be appreciated that as long as the electric field strength between the electrode 53 and the anode 14 is sufficient to cause electrons 85 to be emitted from the electrode 53, regardless of whether the electric field strength between the electrode 53 and the anode 14 is greater than the electric field strength between the cathode and the anode 14, active metal is continually sputtered from the electrode 53 during operation thereby refreshing the sputtered metal already residing in the region R2.

Figure 4:
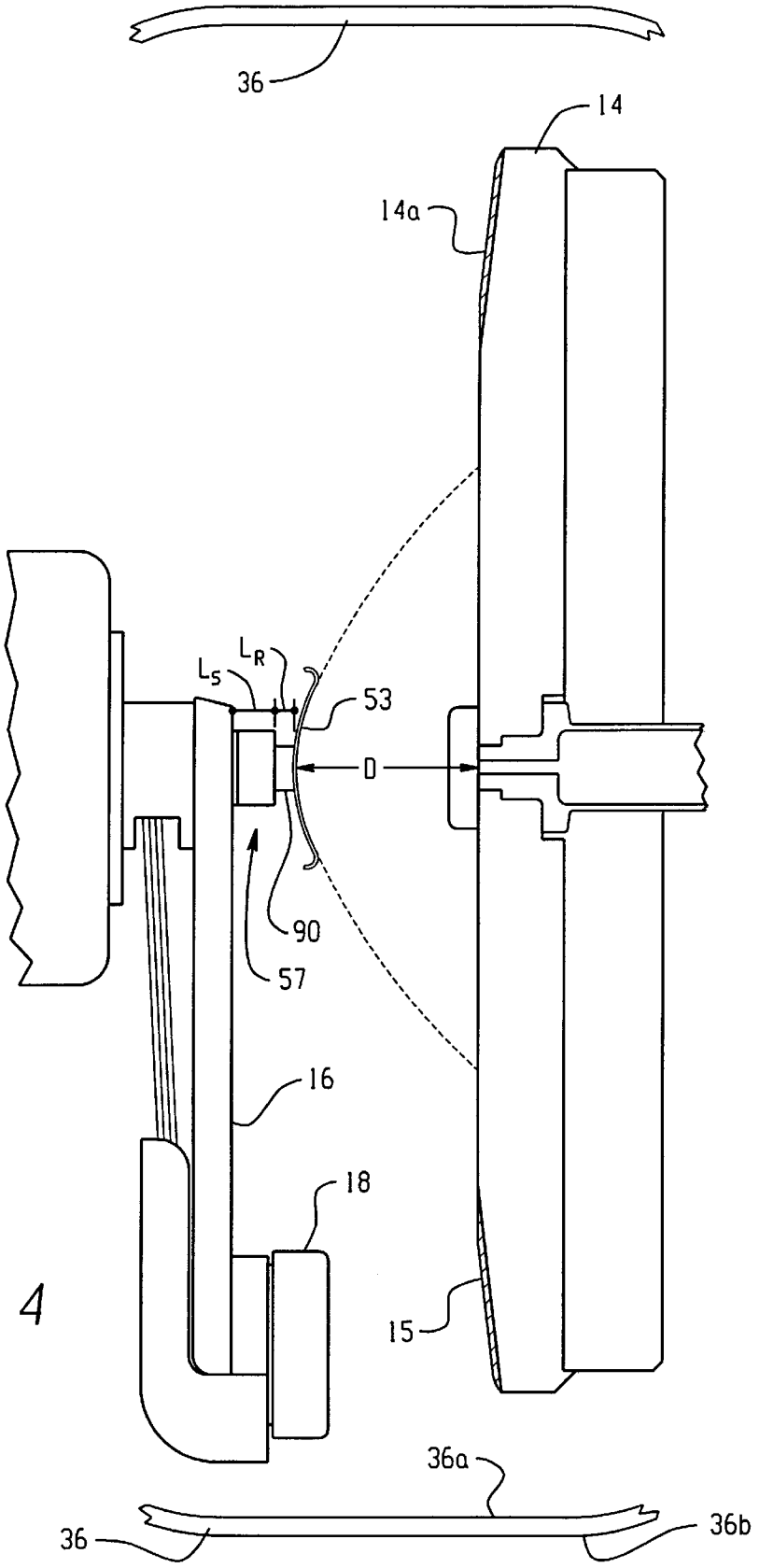
FIG. 4 is an enlarged view of the anode and cathode portions of the x-ray tube of FIG. 1 wherein a resistive element is included in the support structure for the electrode.

Turning now to FIG. 4, an alternative embodiment of the present invention is shown where a resistive plate 90 is mechanically coupled between the standoff 57 and the electrode 53. The resistive plate 90 is brazed at one end to the standoff 57 and at the other end to the electrode 53 thereby providing a stable mechanical connection between these elements. The length $L_R$ and diameter of the resistive plate 90 can be adjusted to accommodate any amount of resistance desired to be placed between the electrode 53 and the cathode 16. The length Ls of the standoff 57 may also be adjusted to account for the added length $L_R$ of the resistive plate 90 such that the distance D between the electrode 53 and the anode surface 14*a* remains at the desired distance as discussed above. The resistive plate 90 may be made of any metal with suitable resistive properties such as titanium, nickel and copper. The purpose of the resistive plate 90 is to limit energy dissipated to the cathode 16 during arcing. It will be appreciated that the same resistive material used in the resistive plate 90 could alternatively be incorporated into the composition of the standoff 57 such that the standoff 57 provides the same resistance between the electrode 53 and the cathode 16 as does the resistive plate 90. In such circumstances, no additional resistive plate 90 would be necessary.

Figure 5:
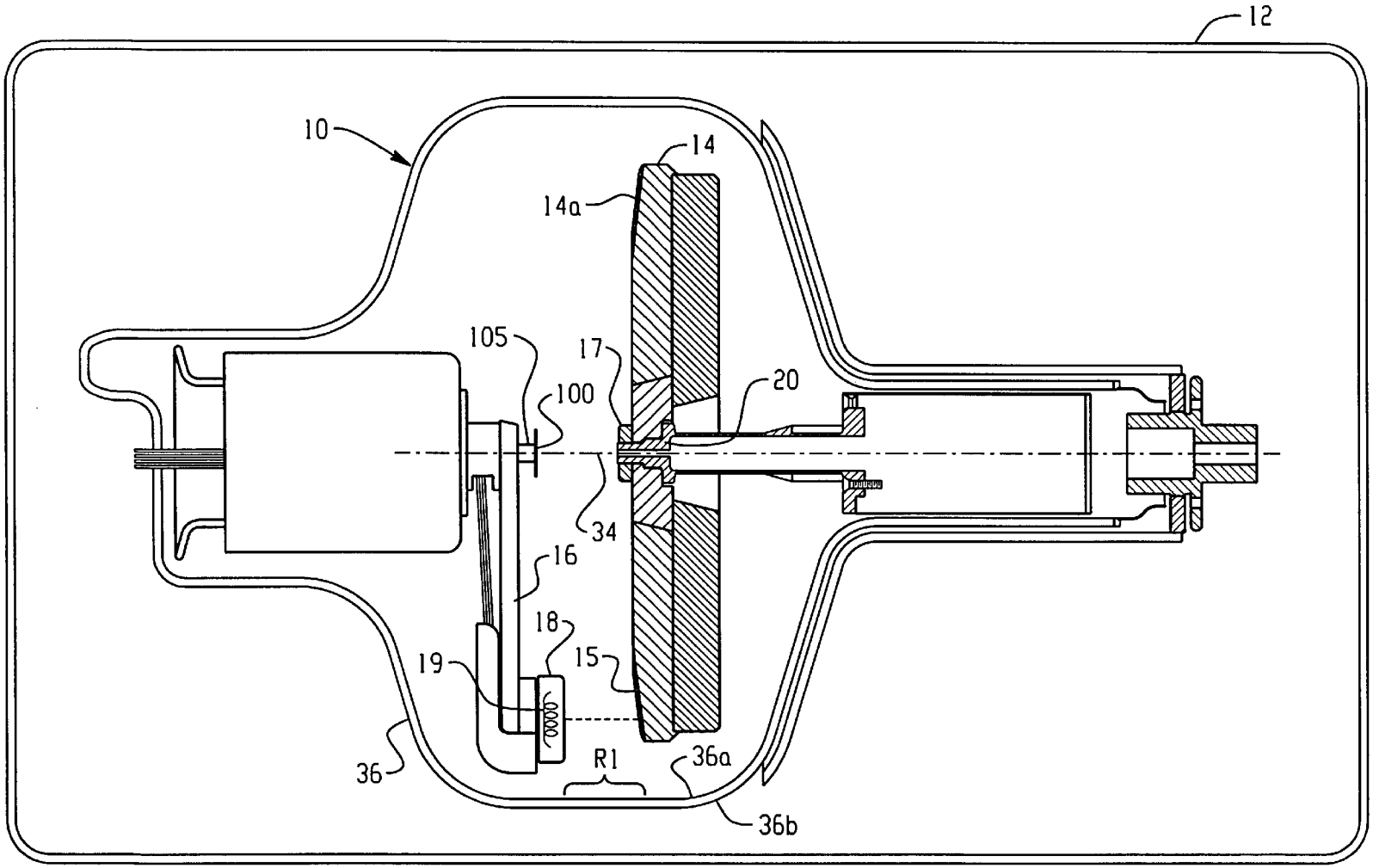
FIG. 5 is a diagrammatic view in partial section of an x-ray tube supported by a housing in accordance with another embodiment of the present invention.

Referring to FIG. 5, yet another embodiment of the present invention is shown, In the present embodiment an element 100 is placed within the envelope 10 and shaped and positioned such that it is passively heated by the anode 14 to preferably a temperature between 600–1000° C. The element 100 may, for instance, be positioned in the same location as the electrode 53 in FIG. 3 and be of a same thickness. The purpose of the element 100 is to serve as a getter for pumping gas from the envelope 10 regardless of the electric field strength between the element 100 and the anode 14. Thus, the element 100 of the present embodiment need not be an electrode. Rather, any element capable of serving as an getter material upon being heated, regardless of the electrical potential of the element 100 or the electrical current flow through the element, may be used. For instance, the element 100 may be comprised of an active metal such as zirconium, titanium, or tantalum.

The element 100 is secured in place by a standoff 105 similar to standoff 57 (FIG. 3). The standoff 105 is made of ceramic and is brazed at one end to the element 100 and at an opposite end to the cathode 16. Unlike the standoff 57 (FIG. 3) discussed above, the standoff 105 does not include a metal layer. Thus, the element 100 is at an undetermined electrical potential.

In operation, the element 100 is passively heated by heat radiated from the anode 14. Upon being heated to an amount sufficient to cause the material of the element 100 to serve as a getter, the element 100 absorbs gas molecules which come into contact with the element 100 thereby helping to maintaining the evacuated state of the envelope 10.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An x-ray tube, comprising:

a cathode;

an anode;

an envelope encompassing the cathode and the anode, the envelope defining a substantially evacuated region in which the cathode and the anode operate to produce x-rays; and means for producing an electric field of a desired strength in a region remote from an internal surface of the envelope, wherein the electric field is of sufficient strength such that arcing preferentially occurs in the region.

2. A method of reducing an amount of metal sputtered onto an internal surface of an envelope of an x-ray tube comprising the step of:

creating an electric field of a desired strength in a region remote from the internal surface of the envelope, wherein the desired strength is such that arcing is more likely to occur in the region remote from the internal surface of the envelope than a region proximate the internal surface of the envelope.

3. The x-ray tube of claim 1, wherein the means for producing an electric field is an electrode.

4. The x-ray tube of claim 3, wherein the electrode is made of an active metal.

5. The x-ray tube of claim 4, wherein the electrode is orientated such that a substantial portion of the active metal sputtered from the electrode lands in a defined region remote from the internal surface of the envelope.

6. The x-ray tube of claim 5, wherein the active metal landing in the defined region serves as a getter material.

7. The x-ray tube of claim 4, wherein heat radiated from the anode heats the electrode such that the active metal serves as a getter for pumping gas from the envelope.

8. The x-ray tube of claim 1 wherein the means for producing an electric field is an electrode, the x-ray tube further comprising:

means for mechanically coupling the electrode to the cathode.

9. The x-ray tube of claim 8, wherein the means for mechanically coupling the electrode to the cathode is a standoff.

10. The x-ray tube of claim 9, wherein the standoff includes a resistive plate.

11. The x-ray tube of claim 3, wherein a face of the electrode is concave.

12. The x-ray tube of claim 11, wherein a peripheral portion of the electrode is curved in a direction opposite the face.

13. The x-ray tube of claim 3, wherein the electrode serves as an ion pump for removing gas from the envelope.

14. An x-ray tube, comprising:

a cathode;

an anode;

an envelope encompassing the cathode and the anode, the envelope defining a substantially evacuated region in which the cathode and the anode operate to produce x-rays; and means for pumping gas from the envelope upon being passively heated by the anode, wherein the means includes an electrode and the electrode is positioned to define an electric field strength between the electrode and the anode greater than an electric field strength between the cathode and the anode.

15. The x-ray tube of claim 14, wherein the means comprises an active metal.

16. A method of creating an electric field of a desired strength in an x-ray tube, the x-ray tube comprising: (i) a cathode, (ii) an anode, and (iii) an envelope encompassing the cathode and the anode, the envelope providing a substantially evacuated region in which the cathode and the anode operate to produce x-rays, the method comprising the steps of:

positioning an electrode within the envelope at a location remote from an internal surface of the envelope, the electrode defining an electric field of a strength such that arcing preferentially occurs between the electrode and the anode; and coupling the electrode to the cathode in the position.

17. The x-ray tube of claim 14, wherein metal sputtered from the electrode serves as a getter material for pumping gas in the envelope.

18. The x-ray tube of claim 17, wherein the electrode is orientated such that substantially all of the metal sputtered from the electrode collects in a defined region remote from an internal surface of the envelope.

19. The x-ray tube of claim 18, wherein the electrode is substantially centered along a rotating axis of the anode.

20. The x-ray tube of claim 14 further comprising a standoff, the standoff mechanically coupling the means to the cathode.

21. The x-ray tube of claim 20, wherein the means comprises an active metal.

22. The x-ray tube of claim 21, wherein the active metal is selected from a group consisting of Zirconium, Titanium, and Tantalum.

23. The x-ray tube of claim 20, wherein the means is an electrode and the standoff includes resistive properties.

24. The x-ray tube of claim 15, wherein a face of the means is concave in shape.

25. The x-ray tube of claim 24, wherein a peripheral portion of the means is curved in a direction opposite the face.

26. An x-ray producing apparatus comprising:

an x-ray tube, including:

(i) a cathode;

(ii) an anode;

(iii) an envelope in which the cathode and the anode are disposed, the envelope defining a substantially evacuated region in which the cathode and anode operate to produce x-rays; and (iv) an electrode disposed in the envelope and positioned such that a substantial portion of metal sputtered from the electrode falls in a defined region remote from an internal surface of the envelope; and a housing for mounting the x-ray tube.

27. The x-ray tube of claim 26 wherein the electrode is made of an active metal.

28. The x-ray tube of claim 26 wherein the electrode defines an electric field strength between the electrode and the anode greater than an electric field strength between the cathode and the anode.

29. The x-ray tube of claim 28 further comprising a standoff, the standoff mechanically coupling the electrode to the cathode.

30. The x-ray tube of claim 28, wherein the electrode is coupled to the anode.

* * * * *